US008612236B2

(12) United States Patent
Gartner et al.

(10) Patent No.: US 8,612,236 B2
(45) Date of Patent: Dec. 17, 2013

(54) METHOD AND DEVICE FOR NOISE SUPPRESSION IN A DECODED AUDIO SIGNAL

(75) Inventors: Martin Gartner, Ekolsund (SE); Stefan Schandl, Vienna (AT)

(73) Assignee: Siemens Aktiengesellschaft, Munich (DE)

( * ) Notice: Subject to any disclaimer, the term of this patent is extended or adjusted under 35 U.S.C. 154(b) by 1504 days.

(21) Appl. No.: 11/632,525

(22) PCT Filed: Apr. 12, 2006

(86) PCT No.: PCT/EP2006/061537

§ 371 (c)(1),
(2), (4) Date: Jul. 30, 2007

(87) PCT Pub. No.: WO2006/114368

PCT Pub. Date: Nov. 2, 2006

(65) Prior Publication Data

US 2007/0282604 A1 Dec. 6, 2007

(30) Foreign Application Priority Data

Apr. 28, 2005 (DE) ..... 10 2005 019 863
Jun. 17, 2005 (DE) ..... 10 2005 028 182
Jul. 8, 2005 (DE) ..... 10 2005 032 079

(51) Int. Cl.
*G10L 19/00* (2013.01)

(52) U.S. Cl.
USPC ..... 704/500

(58) Field of Classification Search
USPC ..... 704/226, 233, 500, 501, 503
See application file for complete search history.

(56) References Cited

U.S. PATENT DOCUMENTS 5,825,320 A * 10/1998 Miyamori et al. ..... 341/139
6,169,971 B1 * 1/2001 Bhattacharya ..... 704/225
6,353,808 B1 * 3/2002 Matsumoto et al. ..... 704/230
6,415,253 B1 * 7/2002 Johnson ..... 704/210
6,442,275 B1 * 8/2002 Diethorn ..... 379/406.14
6,453,282 B1 9/2002 Hilpert et al.
6,453,289 B1 * 9/2002 Ertem et al. ..... 704/225
6,757,395 B1 * 6/2004 Fang et al. ..... 381/94.3

(Continued)

FOREIGN PATENT DOCUMENTS

EP 1 335 353 A2 8/2003
EP 1 440 433 B1 7/2004
JP 08263098 A 10/1996

OTHER PUBLICATIONS

3GPP TS 26.290, Ver. 6.1.0, "Extended Adaptive Multi-Rate—Wideband (AMR-WB+) codec;Transcoding functions", Published Dec. 2004. [online] retrieved from http://www.archive.org.*

Herre et al. "Enhancing the performance of perceptual audio coders by using temporal noise shaping," the 101st AES convention, Nov. 1996.*

Ferreira, "The perceptual audio coding concepts: from speech to high-quality audio coding," AES 17th International Conference, 1999.*

Ted Painter, Andreas Spanias; "Perceptual Coding of Digital Audio"; Proceedings of the IEEE, New York, US; Apr. 2000, pp. 451-513; vol. 88, No. 4; XP002197929; ISSN: 0018-9219.

Yannick Mahieux, Jean Pierre Petit; "High-Quality Audio Transform coding at 64 kbps"; IEEE Transactions on Communications; New York, US; Nov. 1994; vol. 42, No. 11; XP000475155; ISSN: 0090-6778; IEEE Service Center, Piscataway, NJ.

*Primary Examiner* — Jialong He

(57) ABSTRACT

In one aspect, a noise suppression process for a decoded signal comprising a first decoded signal portion and a second decoded signal portion is provided. A first energy envelope generating curve and a second energy envelope generating curve of the first signal portion and of the second decoded signal portion are determined. An identification number depending on a comparison of the first and second energy envelope generating curves is formed. An amplification factor which depends on the identification number is derived. Multiplying the second decoded signal portion by the amplification factor, reduces pre-echo and post-echo interference noises.

13 Claims, 3 Drawing Sheets

(56) References Cited

U.S. PATENT DOCUMENTS

| | | | | |
|---|---|---|---|---|
| 6,978,236 | B1 * | 12/2005 | Liljeryd et al. | 704/219 |
| 7,058,572 | B1 * | 6/2006 | Nemer | 704/226 |
| 7,590,528 | B2 * | 9/2009 | Kato et al. | 704/226 |
| 2001/0029451 | A1 * | 10/2001 | Matsuoka et al. | 704/233 |
| 2003/0009327 | A1 * | 1/2003 | Nilsson et al. | 704/219 |
| 2003/0154074 | A1 * | 8/2003 | Kikuiri et al. | 704/219 |
| 2004/0010407 | A1 * | 1/2004 | Kovesi et al. | 704/219 |
| 2004/0078200 | A1 * | 4/2004 | Alves | 704/233 |
| 2004/0162720 | A1 | 8/2004 | Jang et al. | |
| 2006/0106619 | A1 * | 5/2006 | Iser et al. | 704/500 |
| 2006/0287857 | A1 * | 12/2006 | Saffer | 704/257 |
| 2007/0088541 | A1 * | 4/2007 | Vos et al. | 704/219 |

* cited by examiner

METHOD AND DEVICE FOR NOISE SUPPRESSION IN A DECODED AUDIO SIGNAL

CROSS REFERENCE TO RELATED APPLICATIONS

This application is the US National Stage of International Application No. PCT/EP2006/061537, filed Apr. 12, 2006 and claims the benefit thereof. The International Application claims the benefits of German application No. 102005019863.5 filed Apr. 28, 2005, German application No. 102005028182.6 filed Jun. 17, 2005, and German application No. 102005032079.1 filed Jul. 8, 2005 all of the applications are incorporated by reference herein in their entirety.

FIELD OF INVENTION

The invention relates to a method for decoding a signal which has been coded by a hybrid coder. The invention further relates to a device suitably equipped for decoding.

BACKGROUND OF INVENTION

Different methods have proved to be especially effective for coding audio signals. Thus what is known as the CELP (Code Excited Linear Prediction) technology has proved especially useful for example for high-quality coding of voice signals which exhibit a good quality and with simultaneously low bit rates of the coded data stream. CELP operates in the time domain and is based on an excitation model for a variable filter. In this case the voice signal is represented both by filter parameters and also by parameters which describe the excitation signal.

The appropriate decoders are generally mentioned in relation to coders, with said decoders being able to decrypt or decode the coded data. The corresponding communication devices feature what is known as a codec to enable them to transmit and receive data which is required for communication.

For coding of music and voice signals which are to exhibit a very high quality especially at higher bit rates of the coded data stream, above all perceptual codecs (codec=coder/decoder) have become established. These perceptual codecs are based on a reduction of information in the frequency range and they utilize masking effects of the human hearing system, i.e. for example the fact that specific frequencies or changes that a human being cannot perceive are also not represented. This reduces the complexity of the coder or codec. Since these coders mostly operate with a transformation of the time signal in the frequency domain, in which case the transformation is undertaken for example using MDCT (Modified Discrete Cosine Transformation), these devices are also often referred to as transform coders or codecs. This term will be used within the context of this patent application.

In recent times what are known as scalable codecs have increasingly come into use. Scalable codecs are codecs which generate an excellent audio quality at a relatively high bit rate of the coded data stream. This produces relatively long packets to be transmitted periodically.

A packet is a plurality of data which arises within a period of time and which can also be transmitted together in this packet. Often important data is transmitted first in packets and less important data is transmitted later. The option exists however with these long packets of shortening the packet by removing part of the data, especially by truncating the part of the packet transmitted latest in time. This naturally brings with it a deterioration in quality.

Because of the characteristics previously mentioned it is best for scalable codecs to operate at low bit rates with CELP codecs and at higher bit rates with transform codecs. This has led to the development of hybrid CELP/transform codecs which code a basic signal with good quality according to the CELP method and additionally generate a supplementary signal according to the transform codec method with which the basic signal is improved. This then results in the desired excellent quality.

SUMMARY OF INVENTION

The disadvantage of using these transform codecs is the occurrence of what is known as a "pre-echo effect". This involves a disturbance noise which is distributed evenly over the entire block length of a transform coder block. A block is understood as a totality of data which is coded together. For transform codecs a typical block length amounts to 40 msec. The disturbance noise of the pre-echo effect is caused by quantizing errors of transmitted spectral components. With an even signal level the overall level of this disturbance noise lies below the level of the useful signal. However if one has a useful signal with a zero level followed by a sudden high level, this disturbance noise is clearly audible before the onset of the high level. A well known example of this in literature is the signal waveform for clapping a castanet.

Different methods are already employed for reducing this effect. These however all operate with the transmission of additional information which in its turn makes the design of the coder very complex or forces the coders to work with temporarily increased bit rates.

Using this prior art as its starting point, an object of the present invention is to create a simple option of introducing a reduction of disturbance noise in signals coded using a hybrid coder in which no additional information is needed.

This object is achieved by the object of the independent claims. Advantageous further developments are the object of the dependent claims.

For this disturbance noise reduction in a decoded signal which is made up of a first signal originating for example from a CELP decoder and a second signal originating for example from a transform decoder, the following steps are executed:

An associated energy envelope is determined from the two decoded signal contributions in each case. Energy envelope is especially taken to mean the energy waveform of a signal in relation to time.

A code is formed from a comparison between the two envelopes, for example a ratio.

This ratio in its turn is used to obtain a gain factor.

This method has advantages especially if energy, in the coding method for example, which leads to the first decoded signal contribution is detected more reliably. Then a deviation can namely be detected by the ratio or the gain factor.

In particular the second decoded signal contribution can be multiplied by the gain factor. The above-mentioned deviation can be corrected in this way.

All signals can be subdivided into time segments, in which case especially the time segments which are used for the first decoded signal contribution can be shorter than those for the second.

Because of the higher time resolution, this means that energy deviations in the second signal contribution can be better corrected.

The first signal contribution can originate from a CELP decoder which decodes a CELP-coded signal, the second from a transform decoder which decodes a transform-coded signal. This transform-coded signal can especially also contain the first CELP-decoded signal contribution, which was transform-coded after the decoding, was added to the transform-coded signal transmitted from the transmitter (i.e. already in the frequency range) and is then decoded in the transform decoder as a contribution to the second signal contribution.

As an alternative to this a sum can also be formed from the transmitted CELP-coded signal and the transmitted transform-coded signal in the time domain.

The gain factor can especially be equal to the ratio. Then, if a suitable ratio is formed, a corresponding attenuation of the second decoded signal contribution can be produced if this principally contains the pre-echo noise.

The first decoder in particular can be one based on CELP technology and/or the second coder can be based on a transform decoder. This produces an especially effective noise reduction with simultaneous excellent quality of the decoded signal.

The modification of the received overall signal on the decoder side can especially only be undertaken if specific criteria are met.

In particular there is provision for the modification of the received overall signal to only be undertaken on the decoder side if the signal level change exceeds a specific threshold. This allows an especially effective pre-echo reduction since the pre-echo effect—as already described—primarily arises with changes in level, since then the pre-echo noise lies above the signal level. On the other hand the improvement in quality by the second coder is dispensed with not unnecessarily by this selective modification.

In accordance with a further aspect of the invention a method is created in which, building on the method explained, the decoded signal or its first and second decoded signal contributions are handled separately according to frequency ranges. This has the following advantage. On decoding, the required energy for these frequency bands is known for a number of frequency bands, namely from the energy of the individual first decoded signal contributions separated according to frequency ranges, for example CELP signals. An add-on signal can now be provided by the second decoded signal contribution which however can deviate significantly in its energy. It is particularly problematic when the energy of the second decoded signal contribution is significantly too high, for example as a result of pre-echo effects. The method now introduces for each individually handled frequency band a restriction of the energy (or of the level) of the second signal contribution depending on the energy of the first signal contribution. This method is all the more effective the more frequency bands are handled separately in this way.

BRIEF DESCRIPTION OF THE DRAWINGS

Further advantages of the invention will be presented with reference to typical exemplary embodiments.

The figures show.

DETAILED DESCRIPTION OF INVENTION

Figure 1:
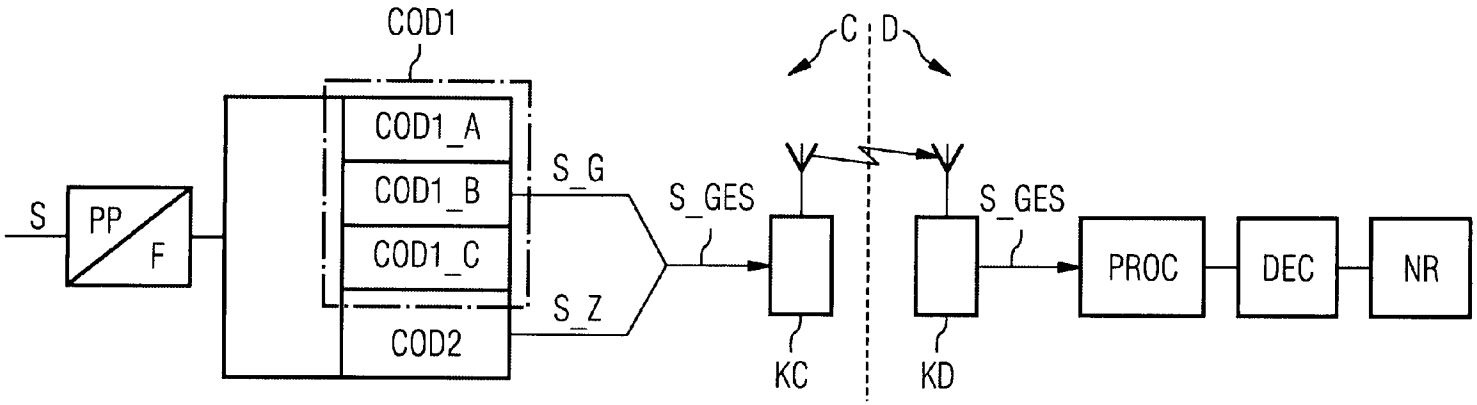
FIG. 1 a diagram of the major components on a coding side and a decoding side to illustrate the typical execution sequence of a coding/decoding process.

FIG. 1 shows a schematic diagram of the execution sequence of a coding and decoding process with reference to an exemplary embodiment. On a coding side C an analog signal S to be transmitted to a receiver is preprocessed or prepared by being digitized for coding by a pre-processing device PP. The signal is further fragmented into time segments or frames in a fragmentation unit F. A signal prepared in this manner is fed to a coding unit COD. The coding unit COD features a hybrid coder comprising a first coder, a CELP coder COD1 and a second coder, a transform coder COD2. The CELP coder COD1 comprises a plurality of CELP coders COD1_A, COD1_B, COD1_C, which operate in different frequency ranges. This division into different frequency ranges enables especially accurate coding to be guaranteed. Furthermore this division into different frequency ranges provides very good support for the concept of a scalable codec, since, depending on the desired scaling, only one frequency range, a number of frequency ranges or all frequency ranges can be transmitted. The CELP coder COD1 supplies a basic contribution S_G to the coded overall signal S_GES. The transform coder COD2 supplies an additional contribution S_Z to the coded overall signal S_GES. The coded overall signal S_GES is transmitted by means of a communication device KC on the coding side C to a communication device KD on a decoding side D. Here the data or the received coded overall signal S_GES is processed (for example the signal is split up into the contributions S_G and S_Z) in a processing device PROC, with the processed data or the processed signal subsequently being transmitted to a decoding device DEC for subsequent decoding DEC (cf. also FIGS. 3 and 4). The decoding is followed by a noise reduction in a noise reduction unit NR which is shown in greater detail in FIG. 3.

Figure 2:
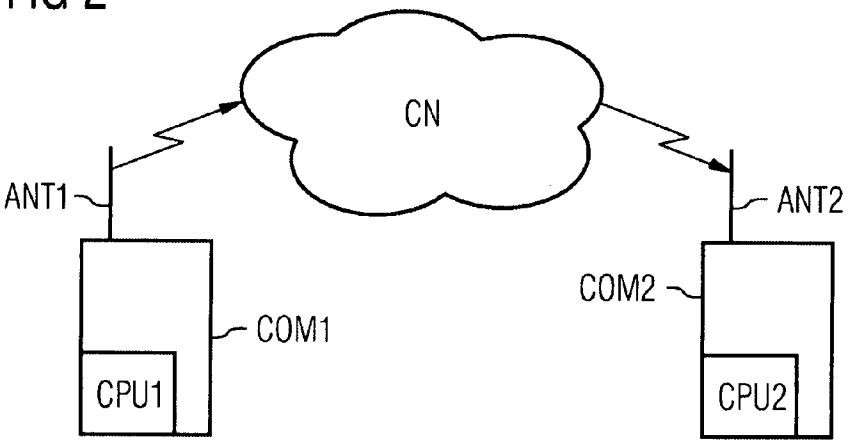
FIG. 2 a schematic diagram of a communication system for transmission of a coded signal between communication devices over a communication network.

FIG. 2 shows a first communication device COM1 (for example representing the components on the coding side C of FIG. 1) which features a transmit and receive unit ANT1 (for example corresponding to the communication device KC) for transmitting and/or receiving data, as well as a central processing unit CPU1 which is set up for implementing the components on the coding side C or for executing the coding method shown in FIG. 1 (processing on the coding side C). The data is transmitted by means of the transceiver unit ANT1 over a communication network CN (which for example, depending on communication devices to be used, can be set up as an Internet, a telephone network or a mobile radio network). The data is received by a second communication device COM2 (for example representing the components on the right-hand side of FIG. 1), which once again features a transceiver unit ANT2 (for example corresponding to the communication device KB), as well as a central processing unit CPU2 which is set up for implementing the components on the decoding side D or for executing a decoding method (processing on the decoding side D) in accordance with FIG. 1. Examples of possible implementations of communication devices COM1 and COM2, in which this method can be applied, are IP telephones, voice gateways or mobile telephones.

Figure 3:
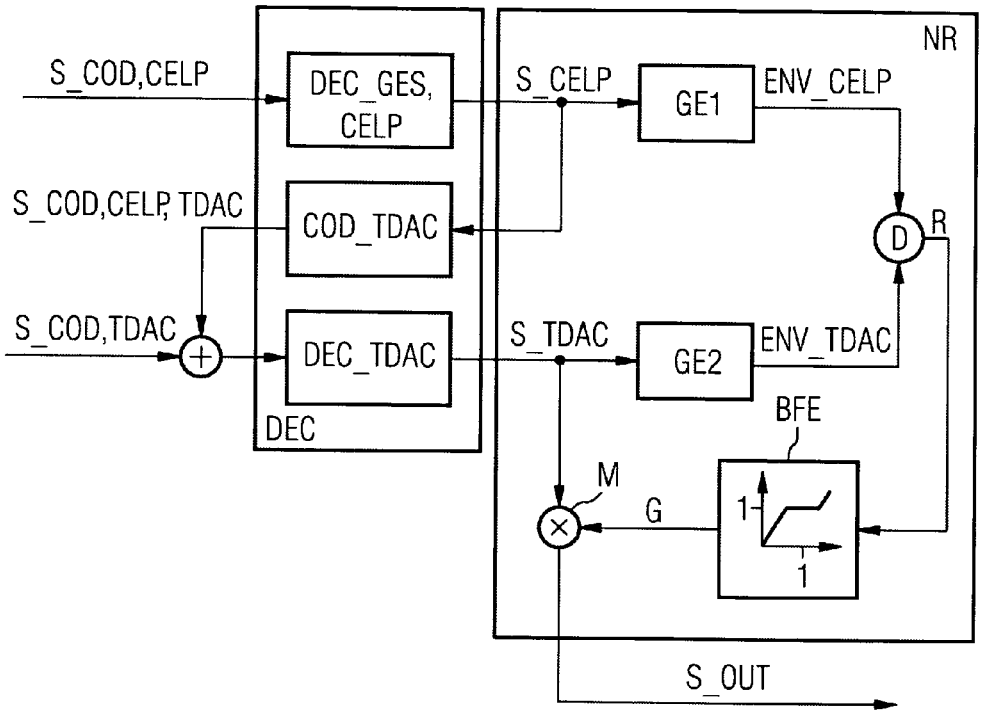
FIG. 3 a decoding device or a noise suppression device to illustrate the reduction of pre-echo with the aid of gain adaptation, which is based on a CELP signal.

The reader is now referred to FIG. 3 in which the decoding device DEC and the noise reduction device NR can be seen with the main components for schematic depiction of the execution sequence of a pre-echo reduction.

A CELP coder signal S_COD,CELP (corresponding to the signal S_G) is decoded by means of a full-band CELP decoder DEC_GES,CELP. The decoded signal S_CELP is forwarded on the one hand to a (first) energy envelope determination unit GE1 for determining the associated envelope ENV_CELP, on the other hand to a TDAC (Time domain aliasing cancellation) Coder COD_TDAC. The TDAC coding is an example of a transform coding.

The coded signal S_COD,CELP,TDAC is routed, together with the transform coding signal S_COD,TDAC originating from the receiver side (corresponding to the signal S_Z), to a transform decoder DEC_TDAC in order to create a decoded signal S_TDAC. The associated energy envelope ENV_TDAC is also determined from this decoded signal S_TDAC in a (second) energy envelope determination unit GE2. In a ratio determination unit D the ratio R of the energy envelopes to each other is determined as a code for each time segment. In a condition establishment unit BFE it is established whether the ratio R has a defined minimum spacing of 1 (1: both energy envelope curves are the same), i.e. the levels of the signals are the same or at least only deviate from each other by a predetermined percentage.

The result is then a gain factor or attenuation factor G which, in the case shown, is the same as the ratio R (code) with which the transform-decoded signal contribution S_TDAC is multiplied in a multiplication device M in order to obtain a final reduced-noise signal S_OUT. In more precise terms, it is assumed for example that the ratio R is formed by R=ENV_CELP/ENV_TDAC, and if it has been determined that this ratio may not fall below a predetermined threshold value SW, when the ratio falls below the threshold value SW, the transform-decoded signal contribution S_TDAC is multiplied by a gain factor G, for example G=R, which leads to an attenuation of the signal contribution S_TDAC. It is further possible, in the event that the threshold value SW is not undershot, to assign the value "1" to the gain factor G, so that for a multiplication of the signal contribution S_TDAC, which can then be undertaken in any event, the value S_TDAC remains unchanged.

Thus in the case of a deviation of the energy of the transform-decoded signal contribution S_TDAC, with the deviation also being the said pre-echo effect, the energy or the level of this signal contribution is moved to a more reliable value of the CELP channel-decoded signal S_CELP so that the final signal S_OUT is noise-reduced.

Figure 4:
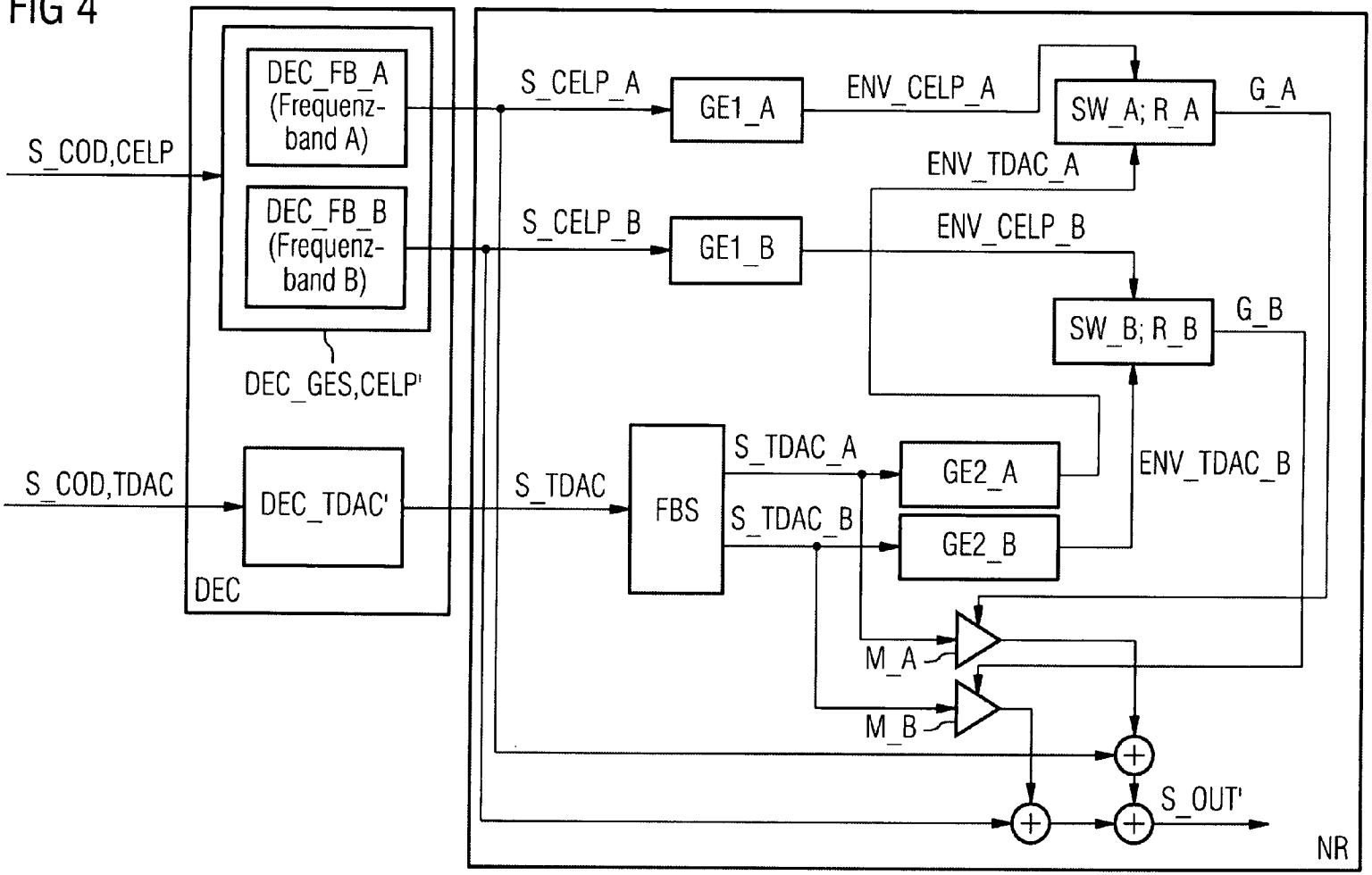
FIG. 4 a further embodiment for level adaptation or for reduction of pre-echo.

The reader is now referred to FIG. 4, with reference to which a further embodiment for reducing the pre-echo effect is to be explained.

It is possible, instead of only one CELP codec, for a number of (CELP or other) codecs separated according to frequency ranges to be available. The embodiment shown in FIG. 4 largely corresponds to the embodiment shown in FIG. 3 and represents an expansion with regard to the latter, in that the method shown in FIG. 3 is not applied to the overall signal of CELP (or other) decoders and transform decoders but that the method is applied separately according to frequency ranges. This means that the overall signal or the individual signal contributions are first divided up in accordance with frequency ranges, with the method of FIG. 3 then being able to be applied for each frequency range to the individual signal contributions.

The advantage of this is explained below. The required energy for these frequency bands is known at the decoder for a number of frequency bands, namely from the energy of the individual CELP signals separated according to frequency ranges. The transform decoder now delivers an add-on signal, which however can deviate significantly in its energy. The situation is problematic above all if the energy of the signal from the transform decoder is significantly too high, e.g. as a result of pre-echo effects. The method now leads for each individually handled frequency band to a restriction of the transform codec energy depending on the CELP energy. This method is all the more effective the more frequency bands are handled separately in this way.

This will immediately become clear with reference to the following example:

Let the overall signal consist of a 2000 Hz tone which comes entirely from the CELP codec proportion. In addition, because of pre-echo effects, the transform codec now supplies a further noise signal with a frequency of 6000 Hz; the energy of the noise signal is 10% of the energy of the 2000 Hz tone.

Let the criterion for restriction of the transform codec proportion be that this may be at most as large as the CELP proportion. Case 1: No splitting according to frequency bands is done (first embodiment): Then the 6000 Hz noise signal is not suppressed since it has only 10% of the energy of the 2000 Hz tone from the CELP codec.

Case 2: The frequency bands A: 0-4000 Hz and B: 4000 Hz-8000 Hz are handled separately (further embodiment): In this case the noise signal is suppressed completely since in the upper frequency band the CELP proportion is zero, and thus the transform codec signal is also limited to the value zero.

In FIG. 4 (as in FIG. 3) a decoding device DEC and a noise reduction device NR with the main components for schematic presentation of the execution sequence of a level adaptation or pre-echo reduction can now again be seen. The reader is again referred to FIGS. 1 or 2 for the creation of coded signals or for the transmission to a receiver.

A CELP-coded signal S_COD,CELP (corresponding to signal contribution S_G) is decoded by means of a full-band CELP decoder DEC_GES,CELP'. The full-band CELP decoder in this case comprises two decoding devices, a first decoding device DEC_FB_A for decoding the signal S_COD,CELP in a first frequency band A and a second decoding device DEC_FB_B for decoding the signal S_COD,CELP in a second frequency band B. A first decoded signal S_CELP_A is routed to a (first) energy envelope determination unit GE1_A for determining the associated envelope ENV_CELP_A, while a second decoded signal S_CELP_B is routed to a (second) energy envelope determination unit GE1_B for determining the associated envelope ENV_CELP_B.

A transform coding signal S_COD,TDAC (corresponding to the signal S_Z) originating from the receiver side is routed to a transform decoder DEC_TDAC, in order to create a decoded signal S_TDAC, which in its turn is routed to a frequency band splitter FBS. This divides the signal S_TDAC into two signals, namely S_TDAC_A for frequency band A and S_TDAC_B for frequency band B. The subdivision into frequency bands can optionally also be undertaken in the frequency domain, before the return transformation into the time domain. This means that the delay especially associated with the frequency band splitters operating in the time domain (highpass, lowpass or bandpass filter) is avoided. The associated energy envelope curves ENV_TDAC_A or ENV_TDAC_B are also determined from these decoded frequency band-dependent signals S_TDAC_A and S_TDAC_B in a (third) energy envelope determination unit GE2_A or a (fourth) energy envelope determination unit GE2_B.

In a first gain determination unit BDA a gain factor (or also attenuation factor, since the gain is negative) G_A is determined for the frequency band A on the basis of the energy envelopes ENV_CELP_A and ENV_TDAC_A, while in a second gain determination unit BD_B a gain factor (attenuation factor) G_B is determined for frequency band B on the basis of the energy envelopes ENV_CELP_B and ENV_TDAC_B. The respective gain factors can be determined in accordance with the determination shown in FIG. 3 (cf. components D, BFE). In this case for example a respective ratio (code) R_A, R_B of the energy envelopes can again be formed for a respective frequency band A and B, namely R_A=ENV_CELP_A/ENV_TDAC_A or R_B=ENV_CELP_B/ENV_TDAC_B, with a threshold value SW_A or SW_B being determined for a respective frequency band, undershooting of which creates a respective gain factor G_A (for example G_A=R_A) or G_B (for example G_B=R_B) which is finally to be applied to a respective frequency-band-dependent signal S_TDAC_A or S_TDAC_B (in order to bring about an attenuation). If a respective threshold value is not undershot a respective gain factor G_A or G_B can be set to "1", so that on multiplication a respective frequency-band-dependent signal S_TDAC_A or S_TDAC_B remains unchanged.

Finally the gain factor G_A is multiplied by the signal S_TDAC_A and the gain factor G_B is multiplied by the signal S_TDAC_B in a first multiplication unit M_A for frequency band A. Finally the multiplied (possibly attenuated) frequency-band-dependent signals are merged in order to obtain a final reduced-noise (full-frequency) signal S OUT'.

It should be noted that although only a splitting of the decoded signal contributions S_CELP_A, S_CELP_B, S_TDAC_A and S_TDAC_B into two frequency ranges A and B has been undertaken in this example, a splitting up into 3 or more frequencies can be possible and advantageous.

The invention claimed is:

1. A method for noise suppression in an audio signal having been encoded by a hybrid encoder, which produces an encoded signal, and the encoded signal having been decoded by a hybrid scalable decoder, the noise suppression comprising:

(a) determining from a first decoded signal contribution a first energy envelope, the first decoded signal contribution provided by the hybrid scalable decoder having decoded a first signal contribution of the encoded signal into the first decoded signal contribution;

(b) determining from a second decoded signal contribution a second energy envelope, the second decoded signal contribution provided by the hybrid scalable decoder having decoded a second signal contribution of the encoded signal into the second decoded signal contribution;

(c) forming a ratio from a relationship between the first and the second energy envelopes;

(d) deriving a gain factor based on the ratio; and (e) multiplying the second decoded signal contribution by the gain factor when the ratio falls below a predetermined threshold value to reduce pre-echo and post-echo interference noises.

2. The method as claimed claim 1, wherein the first and second decoded signal contributions are split into a plurality of time segments, and wherein the steps a) through e) are performed for each time segment for the respective decoded signal contribution.

3. The method as claimed claim 2, wherein a first length of the time segments for the first decoded signal contribution is different than a second length of the time segments for second decoded signal contribution, and wherein the steps a) through e) are performed for each time segment having a shorter length.

4. The method as claimed claim 1, wherein the first decoded signal contribution stems from decoding a first coding contribution from a first decoder and the second decoded signal contribution stems from decoding a second coding contribution from a second decoder.

5. The method as claimed in claim 4, wherein the second coding contribution includes the first coding contribution.

6. The method as claimed claim 4, wherein the first decoder is formed by a Code Excited Linear Prediction (CELP) decoder.

7. The method as claimed claim 4, wherein the second decoder is formed by a transform decoder.

8. The method as claimed claim 4, wherein the first and second decoder cover the same frequency range.

9. The method as claimed claim 1, wherein the ratio is formed from a ratio of first and second energy envelope.

10. The method as claimed claim 1, wherein the gain factor is the ratio.

11. The method as claimed claim 1, wherein the first decoded signal is formed by decoding a signal stemming from a plurality of first coders that operate in different frequency ranges.

12. The method as claimed claim 1, wherein the encoded signal having been formed from an encoding of the audio signal via the hybrid encoder, encoded by a first method to produce a first signal contribution of the encoded signal and the audio signal encoded by a second encoding method to produce a second signal contribution of the encoded signal.

13. A device for noise suppression comprising:

a central processing unit (CPU) and memory associated with the CPU;

program stored in the memory, wherein when the program is executed on the CPU, performing the method as defined in claim 1.

* * * * *